US005642782A

United States Patent [19]

Grimshaw et al.

[11] Patent Number: 5,642,782

[45] Date of Patent: Jul. 1, 1997

[54] DOWNHOLE CLUTCH ASSEMBLY

[75] Inventors: Allan D. Grimshaw, Alberta; Dwayne S. Norman, Calgary AB, both of Canada

[73] Assignee: Dynamic Oil Tools Inc., Calgary, Canada

[21] Appl. No.: 605,894

[22] Filed: Feb. 23, 1996

Related U.S. Application Data

[62] Division of Ser. No. 580,125, Dec. 28, 1995.

[51] Int. Cl.[6] ..... E21B 17/10; E21B 23/00

[52] U.S. Cl. ..... 166/237; 166/242.6; 166/382

[58] Field of Search ..... 166/237, 208, 166/241.3, 241.4, 242.6, 381, 382

[56] References Cited

U.S. PATENT DOCUMENTS

| | | | |
|---|---|---|---|
| 3,720,261 | 3/1973 | Heilhecker et al. | 166/208 |
| 3,746,090 | 7/1973 | Read et al. | 166/134 |
| 3,802,505 | 4/1974 | Majors, Jr. | 166/136 |
| 3,809,158 | 5/1974 | Bonds et al. | 166/285 X |
| 4,010,804 | 3/1977 | Garcia | 166/208 X |
| 4,030,546 | 6/1977 | Rogers et al. | 166/208 |
| 4,127,168 | 11/1978 | Hanson | 166/123 |
| 4,418,754 | 12/1983 | Stepp | 166/240 X |
| 4,942,925 | 7/1990 | Themig | 166/382 |
| 5,044,441 | 9/1991 | Rubbo et al. | 166/382 |
| 5,139,090 | 8/1992 | Land | 166/369 |

FOREIGN PATENT DOCUMENTS

| | | |
|---|---|---|
| 1274470 | 9/1990 | Canada . |
| 2092647 | 11/1993 | Canada . |
| 2112601 | 8/1996 | Canada . |

*Primary Examiner*—George A. Suchfield

*Attorney, Agent, or Firm*—Dennison, Meserole, Pollack & Scheiner

[57] ABSTRACT

Described is a clutch for providing a rotatable connection between the downhole end of a tubing string and a tubing anchor comprising first and second tubular subs and a connector device between the tubular subs, the connector device initially preventing relative rotation between the tubular subs and thereafter permitting relative rotation.

8 Claims, 6 Drawing Sheets

DOWNHOLE CLUTCH ASSEMBLY

This is a divisional of copending application Ser. No. 08/580,125, filed Dec. 28, 1995.

FIELD OF THE INVENTION

The present invention relates to a method and apparatus for rotatably suspending production tubing in a well bore and more particularly to a rotatable dognut tubing anchoring system including in some cases a downhole clutch for rotatable connection between the tubing and a tubing anchor.

BACKGROUND OF THE INVENTION

There are approximately 50,000 active pumping wells in Western Canada of which approximately 9,000 operate with rotary pumps and the vast majority of the remainder using beam pumps of which approximately 10,000 are high volume lift pumps.

These high volume beam pumps are commonly afflicted with a severe tubing wear problem due to frictional contact between the pump sucker rod and the inner surface of the tubing which ultimately causes tubing perforations, leakage and the need for expensive tubing repairs and/or replacement. In the case of rotary pumps, the problem can be even more severe where the sucker rod rotates within the tubing string at rates of 250 to 600 rpm and where torque from the rotating rod string can actually over-torque the tubing string couplings to cause a complete tubing failure.

Production tubing is normally simply non-rotatably suspended in the well bore from a conventional tubing hanger. However, if the production tubing is suspended rotatably in the well, the problem of rod-to-tubing wear and over-torquing can be substantially alleviated. By periodically rotating the tubing, rod wear in the string is spread evenly around its inner circumference to prolong tubing life and reduce workover costs. Rotatable suspension of the string will also relieve torque buildup associated with rotary pumps particularly when turning at high rpm for pumping heavy concentrations of viscous sand, water and heavy oil mixtures.

While providing these and other advantages, the present system also enhances the well operator's ability to comply with subsisting legislation requiring that during well completions, servicing or reconditioning, the well must be under control and blowout preventers must be installed and maintained to shut down any flow from the well. The present anchoring system is adapted to remain in place attached to the tubing string while the well head is removed and the service rig blowout preventer is installed so that a plug can be installed into the tubing string after the pump rod has been removed to shut off all flow. This plug can be installed through the well head prior to its removal so that the flow is stopped as the service rig blowout preventer is installed.

SUMMARY OF THE INVENTION

Accordingly, it is an object of the present invention to obviate and mitigant from the disadvantages of the prior art.

It is a further object of the present invention to provide a tubing anchoring system which allows production tubing to rotate or be rotated within the well bore.

In one broad aspect the present invention relates to an apparatus for rotatably supporting a tubing string in a well bore comprising tubular coupler means connectable to an uphole end of a tubing string, hanger means disposed annularly about said coupler means in fixed axial relationship thereto, said coupler means being rotatable relative to said hanger means, bowl means for supporting said hanger means therein such that a tubing string connected to said coupler means can be suspended in the well bore, and drive means operably connected to said coupler means and extending through said bowl means for actuation to rotate said coupler means and a tubing string connected thereto.

In another broad aspect the present invention relates to a clutch for providing a rotatable connection between the downhole end of a tubing string and a tubing anchor adapted for connection to an internal surface of a well bore, said clutch comprising a first tubular sub having an uphole and a downhole end, said uphole end being adapted for connection to the downhole end of a tubing string, a second tubular sub having an uphole and a downhole end, the uphole end of said second tubular sub being disposed annularly about said downhole end of said first tubular sub, the downhole end of said second tubular sub being adapted for connection to a tubing anchor, and connector means disposed between said first and second tubular subs, said connector means being adapted to initially prevent relative rotation between said first and second tubular subs for transmission of torque through said clutch means to a tubing anchor connected thereto, said connector means actuatable thereafter to permit relative rotation between said first and second tubular subs.

In another broad aspect the present invention relates to a method of rotatably suspending a tubing string in a well bore comprising the steps of connecting the uphole end of a tubing string to coupler means, rotatably suspending said coupler means from a tubing hanger, connecting said coupler means to drive means by which torque can be transmitted through said drive means to said coupler means for selectively rotating said coupler means by a predetermined amount.

In another broad aspect the present invention relates to a method of rotatably connecting the downhole end of a tubing string to a tubing anchor in a well bore, comprising the steps of connecting the downhole end of said tubing string to a first tubular sub, connecting said tubing anchor to a second tubular sub, providing an initial connection between said first and second tubular subs preventing both relative rotation and axial separation therebetween; fixing said tubing anchor in place in said well bore by means of torque transmitted through tubing string and said first and second tubular subs to said tubing anchor, and rupturing said initial connection between said first and second tubular subs by means of tension applied to said first tubular sub, whereupon said first and second tubular subs may be axially separated by a predetermined amount so that one can rotate relative to the other and so that said tubing string is then rotatable relative to said tubing anchor.

BRIEF DESCRIPTION OF THE DRAWINGS

Preferred embodiments of the present invention will now be described in greater detail and will be better understood when read in conjunction with the following drawings, in which.

DETAILED DESCRIPTION

Figures 1, 1A:
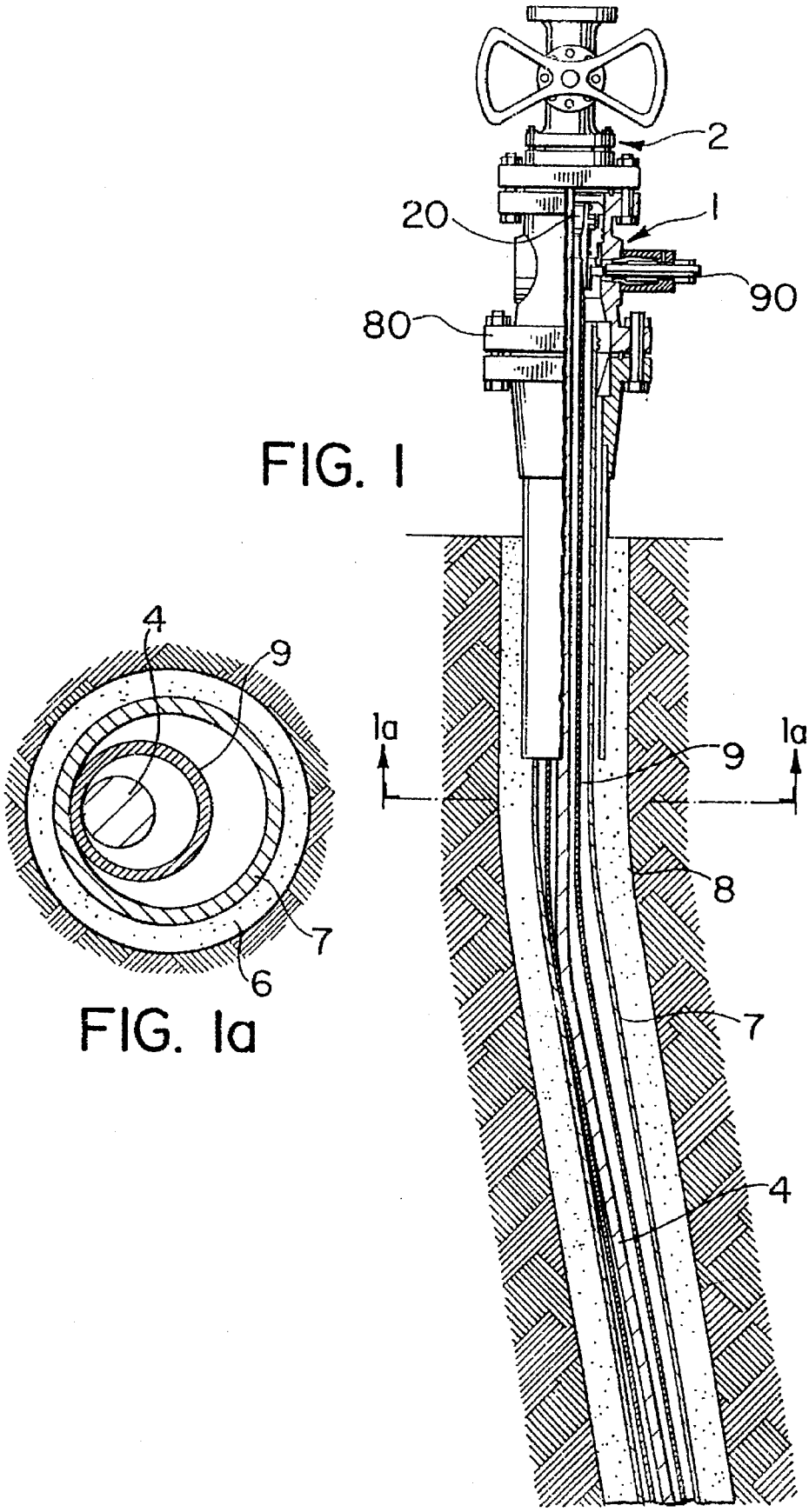
FIG. 1 is a schematical partially cross-sectional view of production tubing suspended in a deviated well bore from a modified tubing hanger as described herein.
FIG. 1*a* is a cross-sectional view of the tubing along line 1*a*—1*a* in FIG. 1.

In FIG. 1, production tubing 9 is shown suspended from the present tubing hanger 1 down a well bore 8 lined with a cemented-in casing 7. A pump sucker rod 4 passes downwardly through the well head 2 (shown only in part), through hanger 1 and down tubing 9 to a downhole pump (not shown). Although well bore 8 will often be vertical, FIG. 1 depicts a deviated well bore to better illustrate the aggravated nature of the rod-to-tubing wear problem in this environment, particularly as further shown in the side bar cross-sectional view of the contact between the rod and tubing at the point where the well deviates FIG. 1*a*.

Figure 2:
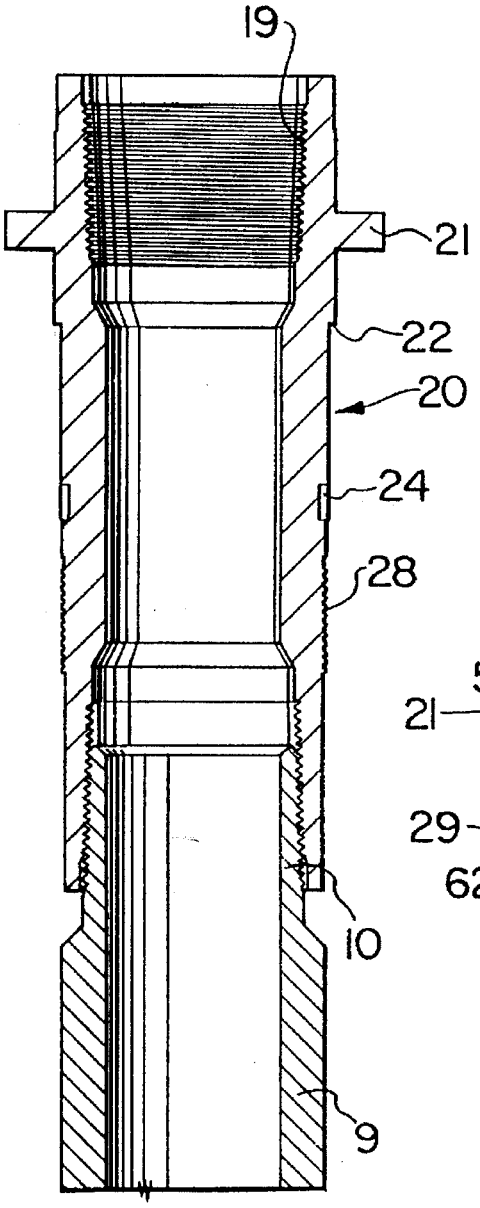
FIG. 2 is a side elevational, cross-sectional view of a coupling attached to the top of a production tubing string.

With reference now to FIG. 2, the top 10 of tubing string 9 is shown threadedly connected to a tubular coupling 20 which forms the inner core of the uphole portion 1 of the present anchoring system as will be described below. Coupling 20 is internally threaded at its uphole end 19 for connection to a flow stopping plug (not shown), and is formed with a circumferential radially extending flange 21, a small shoulder 22, a plurality of radially spaced-apart key slots 24 and an external box thread 28.

Figure 3:
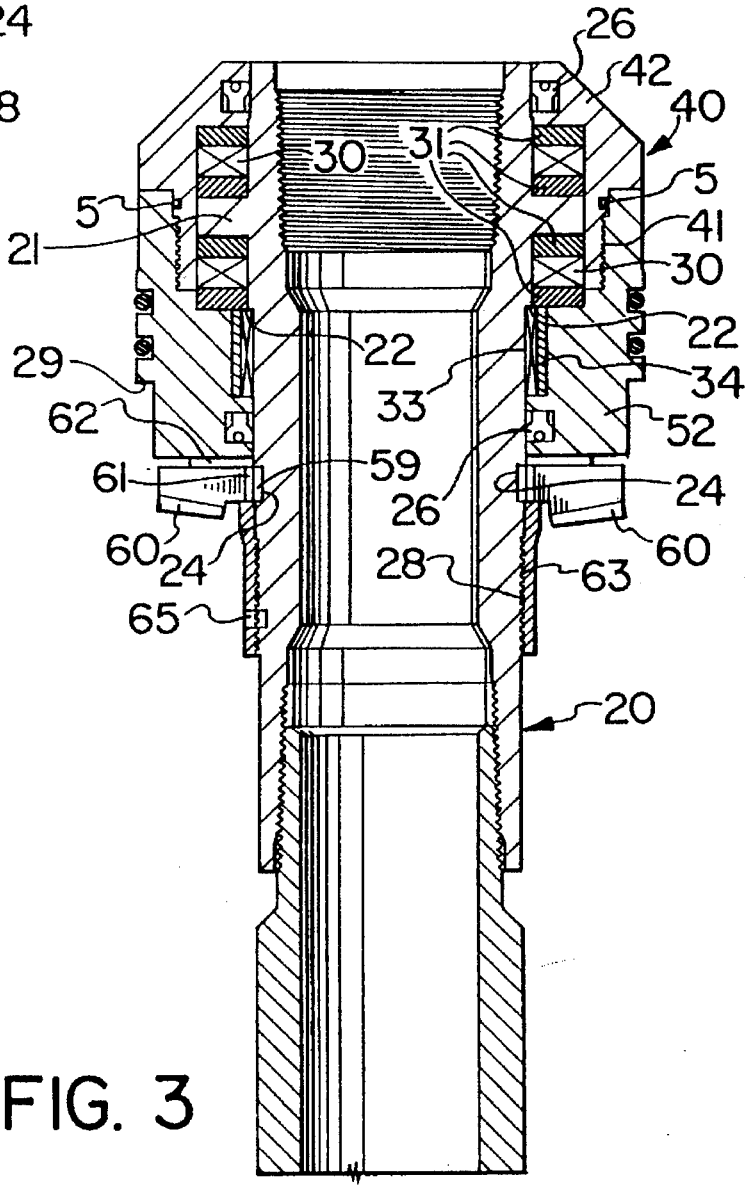
FIG. 3 is a side elevational, cross-sectional view of the coupling of FIG. 2 with a modified tubing hanger dognut assembly thereon.

With reference to FIG. 3, coupling 20 is shown with tubing hanger assembly 40 installed thereon, including a bearing assembly that allows the coupling to rotate relative to the hanger and a spiral bevel gear 60.

Tubing hanger 40 consists of upper and lower hangers or dognuts 42 and 52 respectively, threadedly connected together at 41. Flange 21 is flanked on each of its upper and lower surfaces by thrust bearings 30 which themselves are sandwiched between thrust rings 31. A needle roller bearing 33 and a cooperating race ring 34 are installed around coupling 20 as shown with the upper end of the roller bearing abutting against shoulder 22. Sealing between assembly 40 and coupling 20 is provided by means of polypak seals 26. Additional sealing between upper and lower dognuts 42 and 52 is provided by O-ring 5.

As will be appreciated, the weight of tubing string 9 is transferred to thrust bearings 30 which, together with needle bearing 33, allows coupling 20 to rotate relative to dognuts 42 and 52.

Spiral bevel gear 60 is non-rotatably connected to coupling 20 by means of keys 59 that fit into key slots 24 in the coupling surface and into correspondingly opposed key slots 61 formed in the inner peripheral surface of the gear. A bushing 62 separates the upper surface of gear 60 from the lower surface of lower dognut 52 and the gear is retained in place by a gear retaining cap 63 which connects to box threads 28 on the outer surface of coupling 20. A set screw 65 prevents retaining cap 63 from accidentally backing off.

As will be described below, gear 60 forms part of the drive mechanism for rotating coupling 20 and tubing string 9 connected thereto.

Figure 4:
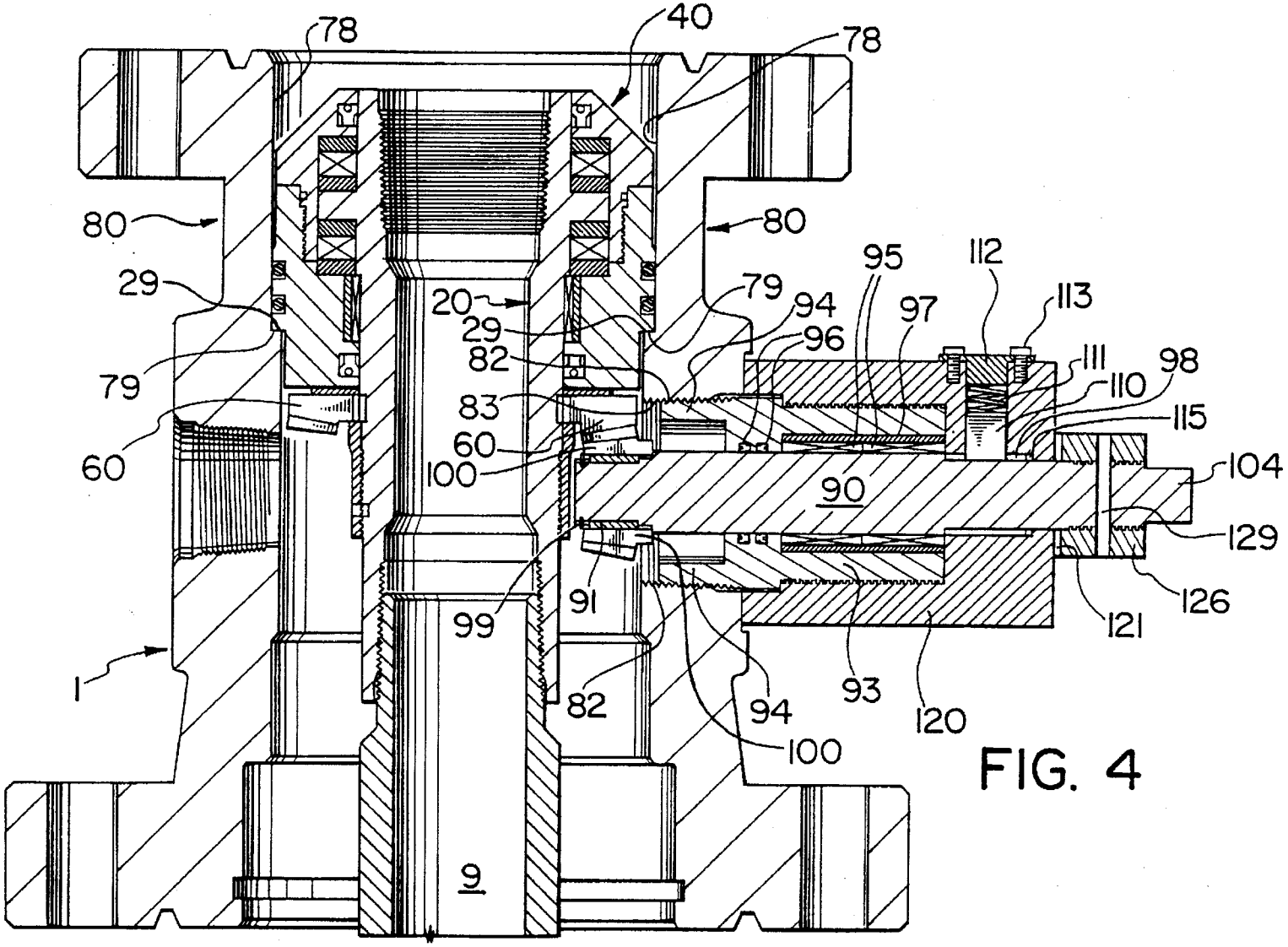
FIG. 4 is a side elevational, cross-sectional view of the tubing hanger of FIG. 3 in a tubing hanger bowl, including a drive mechanism for engaging and rotating the coupling and the tubing attached thereto.

With reference now to FIG. 4, coupling 20 and hanger assembly 40 are shown suspended in a hanger bowl 80 with bevel gear 60 meshed with a mating pinion 100 to form a 90° contact.

As will be seen from FIG. 4, bowl 80 is substantially tubular to support hanger assembly 40 therein by means of contact between an external annular shoulder 29 on lower dognut 52 and an internal cooperating annular shoulder 79 in bore 78 formed through bowl 80.

As aforesaid, bevel gear 60 meshes with pinion 100 which in turn is connected to a shaft 90 which orthogonally exits the hanger bowl through a threaded aperture 82 formed in the bowl's side. Pinion 100 non-rotatably connects to shaft 90 by means of keys 91 and is retained in position by a snap ring 99.

Shaft 90 is centered in aperture 82 by means of a sleeve 93 threaded at its inner end 94 to connect to the pipe threads 83 in aperture 82. Sleeve 93 encloses a bearing ring 97 and needle roller bearings 95 to rotatably support shaft 90 therethrough. Sealing between the shaft and sleeve 93 is provided by polypak seals 96.

Sleeve 93 is externally box threaded for connection to a correspondingly internally threaded housing 120 which, when installed, holds roller bearings 95 in place and also maintains a proper mesh between gear 60 and pinion 100. Housing 120 also encloses a spring loaded ratchet pin 110 that makes contact with ratchet teeth 98 on shaft 90. Ratchet pin 110 is biased against the ratchet teeth on shaft 90 by means of, for example, a spring 111 which is enclosed by a spring backup plate 112 held in place by threaded fasteners 113. A small bushing 115 is placed between teeth 98, housing 120 and shaft 90. A collar 126 is threaded onto shaft 90 behind housing 120 to restrict axial movement of the shaft. A bushing 121 separates collar 126 from housing 120 and a pin member (not shown) can be inserted into a hole 129 formed through the collar and shaft to prevent the collar from backing off. As will be seen, the outer end 104 of shaft 90 is exposed for connection to a wrench or other prime mover for rotation of the shaft. Ratchet teeth 98 are formed to allow only counter-clockwise rotation of shaft 90. Because of the orientation of gear 60 and pinion 100, counter-clockwise rotation of shaft 90 will cause clockwise rotation of coupling 20 and tubing 9 suspended therefrom.

As will be appreciated, the tubing string is now free to rotate in the clockwise direction and can be incrementally rotated at will by counter-clockwise rotation of shaft 90.

Installation of the present anchoring system will now be described for those situations where a downhole tubing anchor is not required so that the tubing string need not be tripped out from the well.

A service rig is moved onto the well and the well is then killed (if necessary). A blowout preventer stack is installed and the sucker rod and bottom hole pump are then removed from the well. At this point, the tubing string in the well is picked up and the existing dognut hanger is removed. The top of the tubing is then plugged temporarily using, for example, a TOOLMASTER POST LOCK™ bridge plug. The tubing and the temporary plug are then run below the surface so that the well is temporarily sealed. The existing hanger bowl is removed and a bowl 80 is installed in its place. The bridge plug and tubing string are then picked up and the plug removed.

At this point, the tubing string is rotated using power tongs with a torque gauge connected thereto. In this way, the maximum torque needed to rotate the string can be determined and also to ensure that the torque applied to the string by the present system does not exceed the string's makeup torque.

After establishing these torque figures, coupling 20 with hanger assembly 40 installed thereon is connected to the top of the tubing string, which is then slowly and carefully lowered into hanger bowl 80 to ensure that gear 60 properly meshes with pinion 100 which has previously been inserted through aperture 82.

Figure 5:
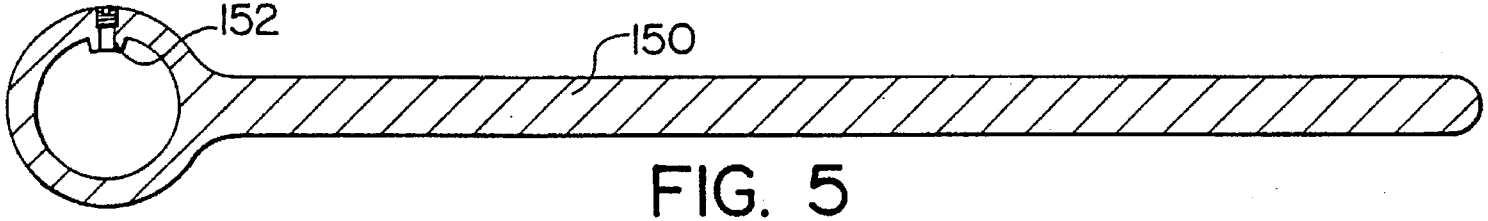
FIG. 5 is a side elevational view of a wrench adapted for actuating the drive mechanism on the tubing hanger of FIG. 4.

Once the present system has been installed as described above, shaft 90 can be actuated by means of a wrench or a torque transmitting motor. A specially adapted wrench 150 developed by the applicant for this purpose is shown with reference to FIG. 5 and includes a shear pin system 152 designed to shear off when the applied torque is slightly less than the makeup torque of the tubing string. Shear pin 152 will also rupture to protect the operator should excessive feedback torque from the tubing string be transmitted through shaft 90. With wrench 150 engaged, the operator will apply left hand or counter-clockwise torque to apply right hand or clockwise torque to coupling 20. Ratchet teeth 98 are splayed to allow 18° of rotation between engagements of ratchet pin 110. The wrench can therefore be removed if desired after every 18° cycle. By rotation of the string in this way, a different inner surface of the tubing is exposed to sucker rod wear. In the case of rotary pump applications, rotation of the string can relieve torque buildups.

Figure 6:
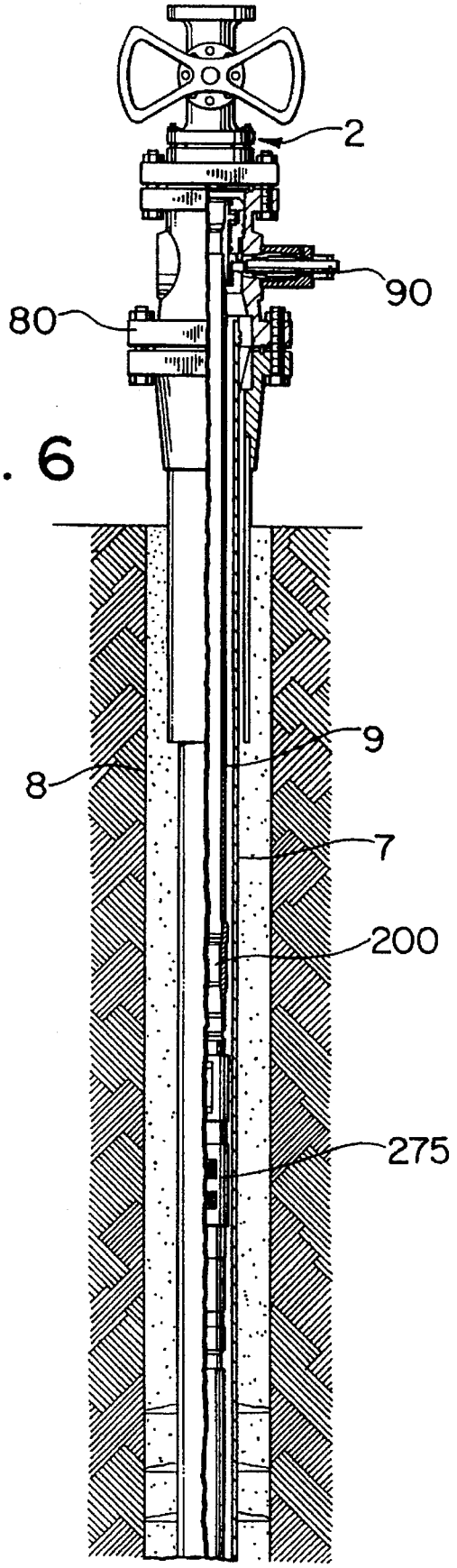
FIG. 6 is a schematical, partially cross-sectional view of production tubing suspended between the hanger of FIG. 2 and a tubing anchor.

A somewhat different approach is required if the downhole end of the tubing string is connected to a tubing anchor. With reference to FIG. 6, a tubing anchor 275 is normally non-rotatably secured to the casing 7 to hold the tubing string 9 in place and, if needed, in tension. Obviously, the otherwise fixed connection between the string and the anchor will defeat the purposes and advantages of the improved hanger described herein by preventing the string from rotating freely. The applicant has therefore developed a downhole clutch 200 to provide a rotatable coupling between the lower end of the string and the tubing anchor.

Figure 7:
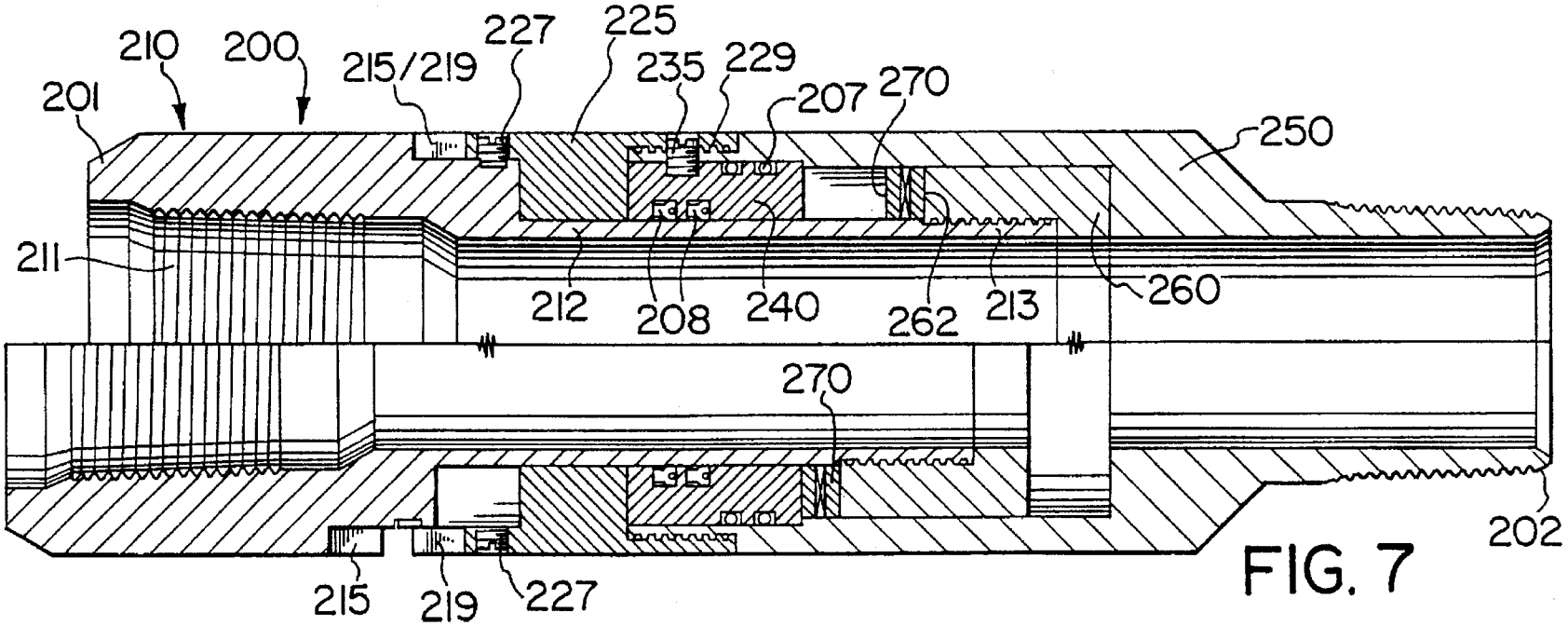
FIG. 7 is a side elevational, cross-sectional view of a clutch member providing a rotatable connection between the downhole end of the tubing string and a tubing anchor.
Figure 8:
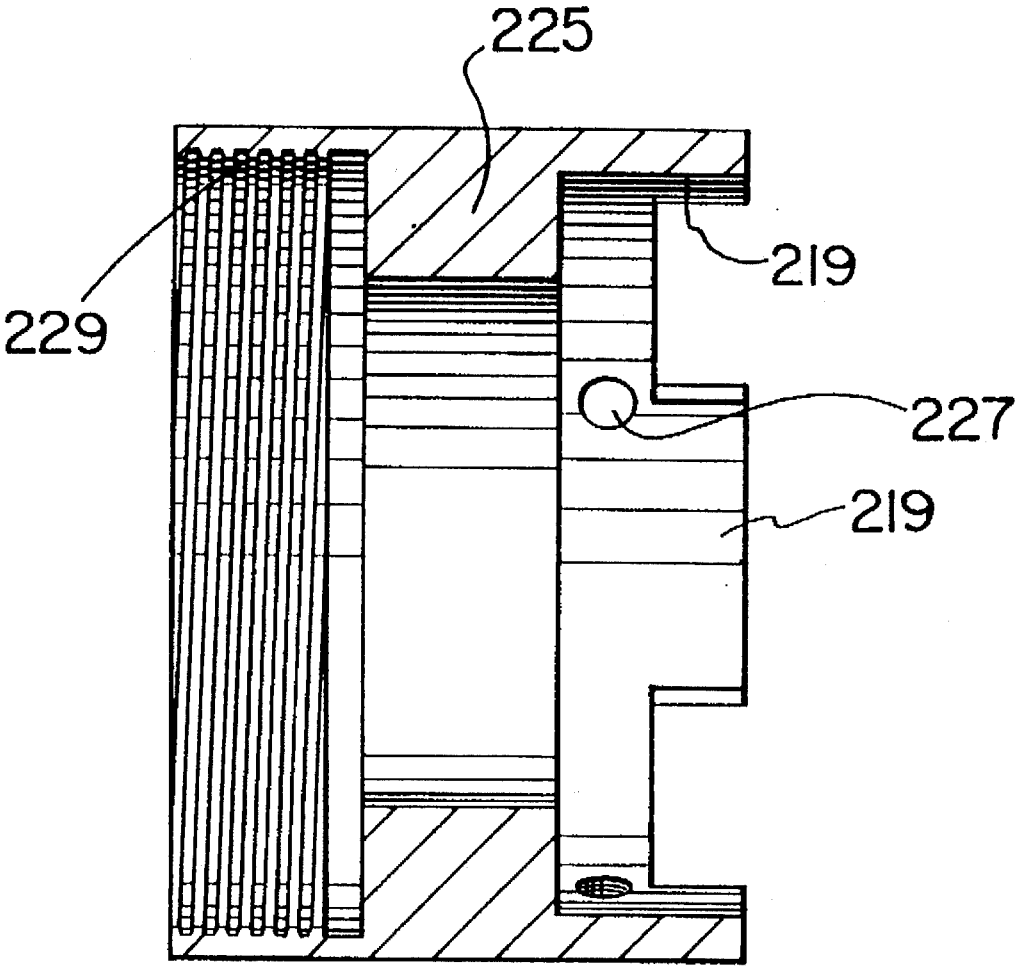
FIG. 8 is a side elevational view of a splined seal retainer forming part of the clutch of FIG. 7.

With reference to FIGS. 7 and 8, clutch 200 includes, starting at its uphole end 201, a tubular top sub 210 internally threaded at 211 for direct threaded connection to the bottom of the tubing. Sub 210 thins into a cylindrical mandrel or stinger 212 which is externally box threaded at its downhole end 213. Top sub 210 additionally includes a set of circumferential, spaced apart teeth or splines 215 adapted to mesh with correspondingly shaped opposed splines 219 formed on a seal retainer 225 which fits annularly onto the outer surface of stinger 212. The shape and orientation of splines 219 on seal retainer 225 are best seen from FIG. 8. Retainer 225 is additionally temporarily attached to top sub 210 by one or more shear screws 227 of a soft metal such as brass or metal steel.

The seal retainer is internally box threaded at 229 for connection to a correspondingly externally threaded tubular bottom sub 250. Bottom sub 250 is also externally threaded at its downhole end 202 for direct connection to the tubing anchor (not shown).

Between the outer surface of stinger 212 and the inner surface of the bottom sub immediately downstream of seal retainer 225 is a seal ring 240 to provide sealing against rotational and static leaking by means of O-rings 207 and polypak seals 208. One or more set screws 235 hold seal ring 240 in place and prevent the accidental backing off of the bottom sub from seal retainer 225.

Finally, a cylindrical bearing cap 260 is threaded onto the downhole end 213 of mandrel 212 with upper surface 262 of the cap providing a shoulder on which a bearing assembly 270 rests.

As seen in the upper half of FIG. 7, with splines 215 and 219 engaged and shear screws 227 intact, rotation of top sub 210 relative to bottom sub 250 is not possible. Thus, with the clutch and anchor secured to the bottom of the tubing, the anchor is run into the hole to the desired depth and a right hand rotation of the string will set the anchor as is conventional in the art. With the anchor thusly set tension is applied to the string and into the clutch to cause shearing of screws 227 and the separation of splines 215 and 219. As best seen from the lower half of FIG. 7, this will bring the bearing assembly 270 resting on the bearing cap into contact with the lower end of seal ring 240. This prevents separation of the top and bottom subs and facilitates relative rotation therebetween. It follows that top sub 210 and the tubing connected thereto are now free to rotate relative to the bottom sub and the tubing anchor.

Installing the present system where a tubing anchor is required is similar to the method described above with the obvious exception that the tubing string must be pulled for attachment of clutch 200 and the tubing anchor. The tubing is then tripped back into the hole to set the anchor and disengage the clutch. Once the clutch has been sheared, the tubing string can be freely rotated between hanger assembly 40 and clutch 200.

The above-described embodiments of the present invention are meant to be illustrative of preferred embodiments of the present invention and are not intended to limit the scope of the present invention. Various modifications, which would be readily apparent to one skilled in the art, are intended to be within the scope of the present invention. The only limitations to the scope of the present invention are set out in the following appended claims.

We claim:

1. A clutch for providing a rotatable connection between the downhole end of a tubing string and a tubing anchor adapted for connection to an internal surface of a well bore, said clutch comprising:

a first tubular sub having an uphole and a downhole end, said uphole end being adapted for connection to the downhole end of a tubing string;

a second tubular sub having an uphole and a downhole end, the uphole end of said second tubular sub being disposed annularly about said downhole end of said first tubular sub, the downhole end of said second tubular sub being adapted for connection to a tubing anchor; and connector means disposed between said first and second tubular subs, said connector means being adapted to initially prevent relative rotation between said first and second tubular subs for transmission of torque through said clutch means to a tubing anchor connected thereto, said connector means actuatable thereafter to permit relative rotation between said first and second tubular subs.

2. The apparatus of claim 1 wherein said connecting means comprise retainer means slidably and rotatably disposed about said downhole end of said first tubular sub, said retainer means being adapted at a downhole end thereof for a fixed non-rotating connection to said uphole end of said second tubular sub and having at an uphole end thereof means adapted to engage cooperating means on said uphole end of said first tubular sub to initially prevent relative rotation between said retainer means and said first tubular sub; shearable members temporarily connecting said retainer means to said first tubular sub to prevent axial separation therebetween; and tubular cap means fixedly connected to said downhole end of said first tubular sub, said cap means at least partially occupying the annulus between said downhole end of said first tubular sub and said uphole end of said second tubular sub, wherein the application of a sufficient tensile force to said first tubular sub will rupture said shearable members to allow axial separation between said first tubular sub and said retaining means and disengagement of said rotation preventing means therebetween, whereupon said first tubular sub becomes rotatable relative to said second tubular sub, said cap means limiting the extent of said axial separation.

3. The apparatus of claim 2 further including seal means disposed annularly between said uphole end of said second tubular sub and said downhole end of said first tubular sub to seal against fluid flow therebetween.

4. The apparatus of claim 3 further including bearing means disposed between said cap means and said seal means to facilitate rotation of said first tubular sub relative to said second tubular sub after rupture of said shearable members.

5. The apparatus of claim 4 wherein said means on said retaining means and said cooperating means on said first tubular sub to initially prevent relative rotation therebetween comprise opposed axially extending splines.

6. The apparatus of claim 5 further including set screw means extending through said retainer means, said uphole end of said second tubular sub and into said seal means to prevent relative rotation between, and to maintain said seal means in position adjacent said retainer means.

7. The apparatus of claim 6 wherein upon rupture of said shearable members and axial separation of said first and second subs, said cap means bias said bearing means against said seal means to limit the extent of said axial separation.

8. The apparatus of claim 7 wherein said shearable members comprise at least one shear screw extending through said retainer means and into said uphole end of said first tubular sub.

* * * * *

UNITED STATES PATENT AND TRADEMARK OFFICE

Certificate

Patent No. 5,642,782 Patented: July 1, 1997

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Dwayne S. Norman, Calgary, Canada.

Signed and Sealed this Eighth Day of September, 1998.

TAMARA L. GRAYSAY, *SPE*
Art Unit 3625